US011077685B2

(12) United States Patent
Wu et al.

(10) Patent No.: US 11,077,685 B2
(45) Date of Patent: Aug. 3, 2021

(54) ALIGNING A CARRIAGE WITHIN A PRINTING DEVICE

(71) Applicants: Hewlett-Packard Development Company, L.P., Houston, TX (US); Xin-Ling Wu, Shanghai (CN); Ying Fang, Shanghai (CN); Wei-Fei Chang, Shanghai (CN); Qiang Tang, Shanghai (CN)

(72) Inventors: Xin-Ling Wu, Shanghai (CN); Ying Fang, Shanghai (CN); Wei-Fei Chang, Shanghai (CN); Qiang Tang, Shanghai (CN)

(73) Assignee: Hewlett-Packard Development Company, L.P., Spring, TX (US)

( * ) Notice: Subject to any disclaimer, the term of this patent is extended or adjusted under 35 U.S.C. 154(b) by 519 days.

(21) Appl. No.: 16/093,476

(22) PCT Filed: Jul. 29, 2016

(86) PCT No.: PCT/CN2016/092223

§ 371 (c)(1),
(2) Date: Oct. 12, 2018

(87) PCT Pub. No.: WO2018/018580

PCT Pub. Date: Feb. 1, 2018

(65) Prior Publication Data

US 2021/0187983 A1 Jun. 24, 2021

(51) Int. Cl.
*B41J 25/00* (2006.01)

(52) U.S. Cl.
CPC ..... *B41J 25/001* (2013.01)

(58) Field of Classification Search
CPC ..... B41J 25/001
See application file for complete search history.

(56) References Cited

U.S. PATENT DOCUMENTS 5,585,825 A * 12/1996 Kneezel ..... B41J 2/1752 347/14
5,901,644 A 5/1999 Etheridge et al.
6,739,692 B2 5/2004 Unosawa
(Continued)

FOREIGN PATENT DOCUMENTS

CN 1385317 A 12/2002
CN 101088762 A 12/2007
(Continued)

OTHER PUBLICATIONS

Barranca, D., Epson 11880 Printer Head Deep Cleaning, Feb. 11, 2014, http://www.davidebarranca.com/ ~ 7 pages.

*Primary Examiner* — Justin Seo
(74) *Attorney, Agent, or Firm* — Brooks Cameron & Huebsch PLLP

(57) ABSTRACT

A printing device (100, 200) may include a carriage (101, 201) to hold an integrated printhead (103, 203) in the printing device; a manifold latch (105, 205) to connect the integrated printhead and an ink tank connector in a locked position; and a controller (109, 209) to align the carriage within the printing device based on a level of health of the integrated printhead and a latching position of the manifold latch. Furthermore, a non-transitory computer readable medium and a printing method are disclosed.

15 Claims, 4 Drawing Sheets

(56) References Cited

U.S. PATENT DOCUMENTS

| | | | |
|---|---|---|---|
| 8,147,027 | B2 | 4/2012 | Hara |
| 8,342,626 | B2 | 1/2013 | Kawamata |
| 8,388,107 | B2 | 3/2013 | Garcia et al. |
| 2001/0012027 | A1 | 8/2001 | Murcia et al. |
| 2002/0154192 | A1 | 10/2002 | Balakrishnan et al. |
| 2005/0024421 | A1 | 3/2005 | Barinaga et al. |
| 2005/0168504 | A1 | 8/2005 | Pan et al. |
| 2008/0252670 | A1 | 10/2008 | LaBar |
| 2011/0076046 | A1 | 3/2011 | Oh |
| 2013/0093815 | A1 | 4/2013 | Kawamata et al. |
| 2013/0194354 | A1 | 8/2013 | Petruchik |

FOREIGN PATENT DOCUMENTS

| | | | |
|---|---|---|---|
| CN | 101234556 | A | 8/2008 |
| CN | 202826729 | U | 3/2013 |
| EP | 0890442 | A1 | 1/1999 |
| EP | 1952991 | | 8/2008 |
| JP | H08-169121 | | 7/1996 |
| JP | 2001063031 | A | 3/2001 |
| JP | 2002-284354 | | 9/2002 |
| JP | 2004-519362 | | 7/2004 |
| JP | 2007-331309 | | 12/2007 |
| JP | 2008-188839 | | 8/2008 |
| JP | 2011056840 | | 3/2011 |
| JP | 2011-194608 | | 10/2011 |
| JP | 2016-093921 | | 5/2016 |

* cited by examiner

ALIGNING A CARRIAGE WITHIN A PRINTING DEVICE

BACKGROUND

Printing devices may include printheads or pens which deliver ink onto or into a medium. Various components may house the printhead or printheads and may be accessible to varying degrees by a user. Under some circumstances components of the printing device may be damage by a user accessing the printhead, printheads, or other components within the printing device.

DETAILED DESCRIPTION

In some printing devices, such as continuous ink supply systems, a tube may connect the printhead with an ink tank to provide ink continuously. Various components, including ink tank tubing, within the printing device may connect the printhead to the ink tank, and may be accessible by a user. However, if such components are accessed when the printhead is not in need of service, the ink may flow backwards into ink tank. In such instances, the printhead may not be able to get the ink through the ink tank tubing due to air in the tubing. Once the printhead is out of ink, it may be damaged and may need to be replaced.

Some printing devices may maintain the printhead in a particular position perpetually, and require that a user press a series of buttons to move the printhead out and install a new one. In contrast, aligning a carriage within a printing device, in accordance with the present disclosure, may allow for detection of printhead (e.g., pen) health. If the printhead health is good, as described herein, the printhead may be maintained in a capped position. If, however, the printhead has malfunctioned in some manner, the printhead may move to a position whereby a user may change the printhead.

Figure 1:
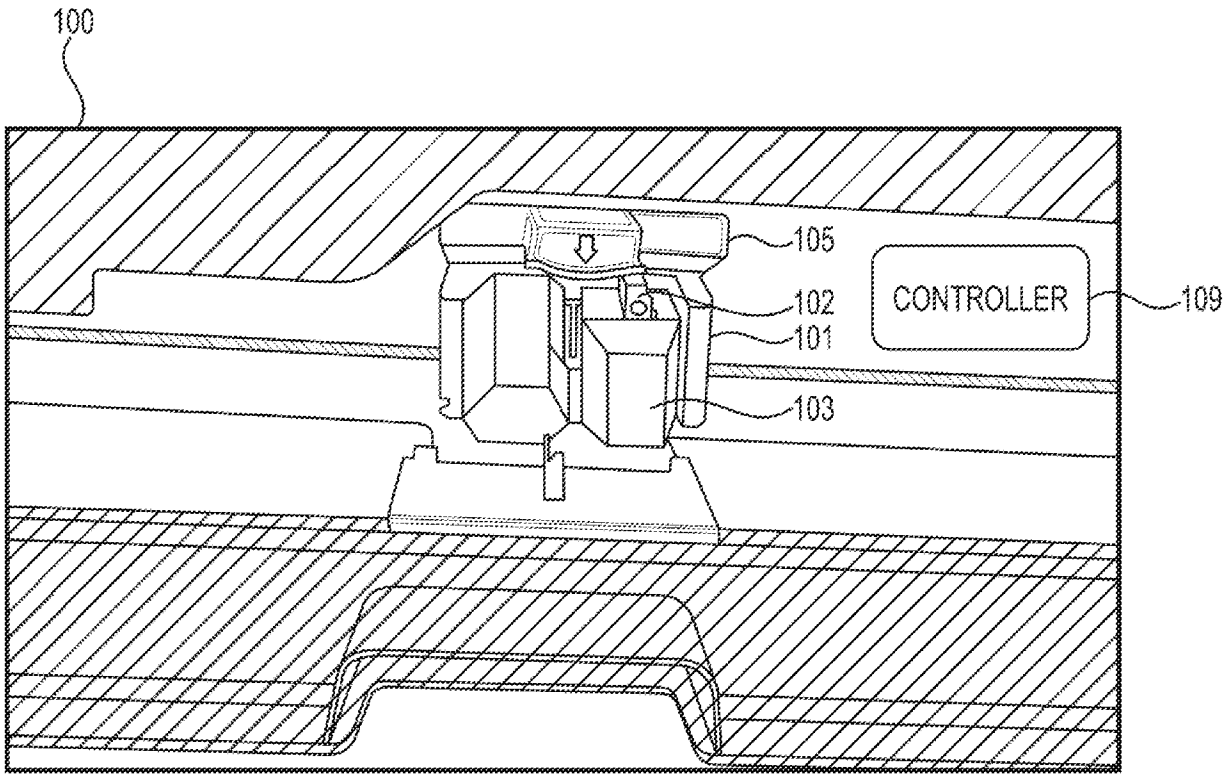
FIG. 1 illustrates a diagram of a printing device, according to the present disclosure.

FIG. 1 illustrates a diagram of a printing device 100, according to the present disclosure. As illustrated in FIG. 1, the printing device 100 may include a carriage 101 to hold an integrated printhead 103 in the printing device 100. As used herein, an integrated printhead refers to a print head that is integrated into an ink cartridge. As described herein, the integrated printhead 103 includes a pen body, and a plurality of nozzles for delivering a printing material (such as ink). The integrated printhead 103 may be coupled to an ink tank, which may be external to the printing device 100, such that a continuous supply of ink may be provided to the integrated printhead 103 via the ink tank. As such, printing device 100 may be referred to as a continuous ink supply system.

As illustrated in FIG. 1, the printing device 100 may also include a manifold latch 105, and the integrated printhead 103 may include an ink tank connector 102. The manifold latch 105 may connect the integrated printhead 103 and the ink tank connector 102 in a locked position. For instance, a tube or connecting material may connect an ink tank to the manifold latch 105. That is, the ink tank tubing may be coupled to the ink tank connector 102, and therefore in a "locked" position. By closing the manifold latch 105, the ink tank tubing may connect to the ink tank connector 102, such that ink may be delivered from the ink tank, through the ink tank tubing, and to the integrated printhead 103 via the ink tank connector 102. As described herein, the ink tank tubing may connect to the ink tank connector 102 if the manifold latch 105 is in a "closed" position. As used herein, a "closed" position of the manifold latch 105 refers to a position where the manifold latch 105 is covering a top surface of the carriage 101. In contrast, FIG. 1 illustrates the manifold latch 105 in an "open" position, where the top surface of the carriage 101 is not covered by the manifold latch 105.

The printing device 100 may include a controller 109. Although the controller 109 is illustrated as a box disposed within the printing device 100, it is noted that the controller 109 may be disposed in a different location than illustrated in FIG. 1, and may be within the printing device 100, such as on a printed circuit board (PCB) within the printing device 100. As used herein, a "controller" refers to a component of the printing device 100 that controls various operations of the printing device 100. As such, the controller 109 may perform a number of operations to align the carriage 101 within the printing device 100. For instance, the controller 109 may align the carriage 101 within the printing device 100, based on a level of health of the integrated printhead 103, and a latching position of the manifold latch 105. That is, the controller 109 may determine if the manifold latch 105 is in an opened position, as illustrated in FIG. 1, or a closed position. Furthermore, as described herein, the controller 109 may determine a level of health of the integrated printhead 103. As used herein, the "level of health" of the integrated printhead 103 refers to a measurement of whether the integrated printhead 103 has an error or not. Put another way, the integrated printhead 103 may have "poor" health, in that a portion or all of the integrated printhead 103 is malfunctioning. Similarly, the integrated printhead 103 may have "good" health, in that no portion of the integrated printhead 103 is malfunctioning.

Notably, while FIG. 1 illustrates a single integrated printhead 103 inserted in carriage 101, it is noted that more than one integrated printhead 103 may be installed in carriage 101. As illustrated, two integrated printheads may be inserted in carriage 101. In other examples, more than two integrated printheads may be inserted in carriage 101.

Figure 2:
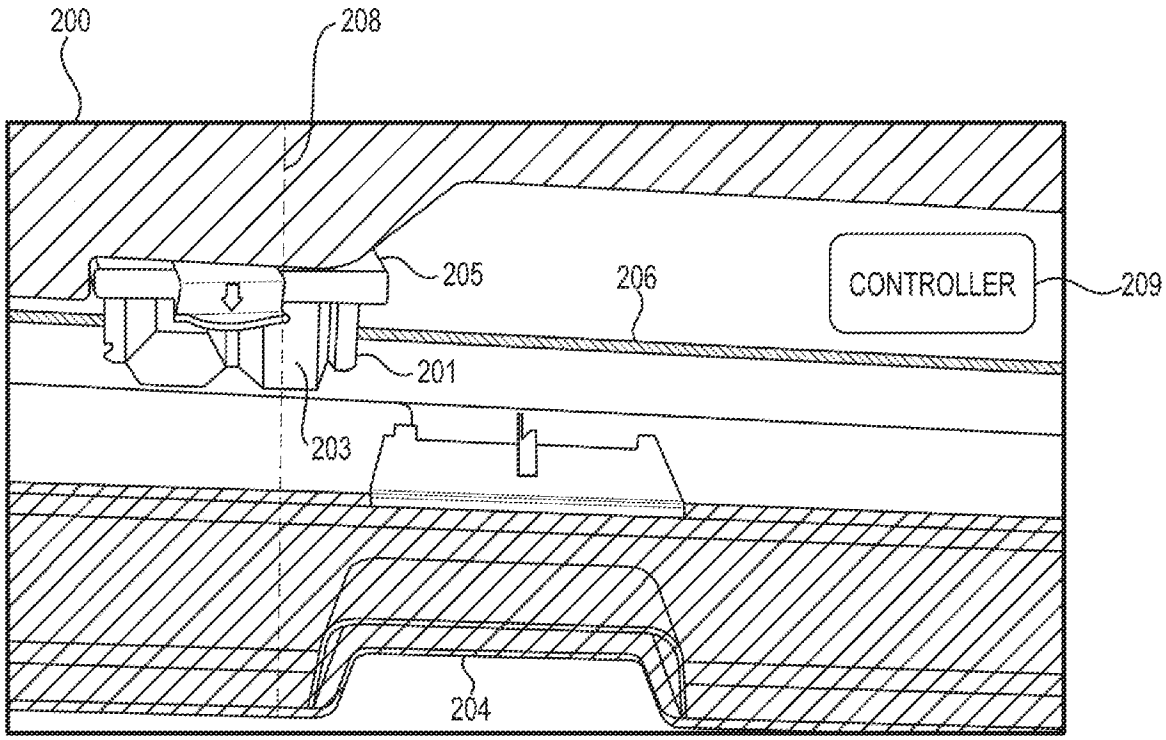
FIG. 2 further illustrates a diagram of a printing device, according to the present disclosure.

Based on the level of health of the integrated printhead 103 and/or the latching position of the manifold latch 105, the controller 109 may align the carriage 101 in a particular position, as described in relation to FIG. 2.

FIG. 2 further illustrates a diagram of a printing device 200, according to the present disclosure. Printing device 200 is analogous to printing device 100 illustrated in FIG. 1. While FIG. 1 illustrates the manifold latch 105 in an "open" position, FIG. 2 illustrates the manifold latch 205 in a "closed" position. As described herein, the controller 209 may align the carriage 201 in various positions, and based on various criteria.

The controller 209 may align the carriage 201 in a "pen present" position, in response to a determination that the manifold latch 205 is in an open position. As used herein, the "pen present" position refers to a position of the carriage 201 within the printing device 200, such that the integrated printhead 203 may be accessed by a user. That is, in the pen present position, the carriage 201 may be aligned in front of a door latch 204 of the printing device 200. Carriage 101 is illustrated in pen present position in FIG. 1. Put another way, the pen present position refers to a position of the carriage 201 within printing device 200 that allows a user to open the manifold latch 205 and access the integrated printhead 203.

The controller 209 may align the carriage 201 in the pen present position for a number of reasons. For example, the controller 209 may align the carriage 201 in the pen present position in response to a determination that the manifold latch 205 is in a closed position, and a pen body in the integrated printhead 203 has an error. As used herein, to determine that the integrated printhead has "an error", refers to a determination that the printhead or some component of the printhead is in poor health. That is, to determine that the integrated printhead has "an error" or is in "poor health" refers to a determination that the integrated printhead 203 or some component of the integrated printhead 203 is damaged and/or not functioning as it is supposed to.

In contrast, the controller 209 may align the carriage 201 in a capped position. As used herein, a "capped position" refers to a position of the carriage 201 within the printing device 200 where a user may not access the integrated printhead 203. The carriage 201 is illustrated in capped position in FIG. 2. That is, carriage 201 may be moved along bar 206 into a capping device, such that the components of carriage 201 may not be accessed.

While reference is made herein to presenting the carriage 201 in a capped position, examples are not so limited. In some examples, the carriage 201 may be maintained in, or moved to, a position which is difficult for a user to access the manifold latch 205. For instance, the carriage 201 may be moved to a point beyond threshold 208, whereby the components of carriage 201 may not be accessed by a user. While FIG. 2 illustrates the capped position as aligned to the left of the door latch 204, examples are not so limited. For instance, the capped position of carriage 201 may be to the left of door latch 204. In another example, carriage 201 may be moved to a point beyond a threshold to the right of door latch 204. Similarly, the controller 209 may align the carriage 201 in a position in which the user cannot unlock the manifold latch 205. For instance, components within the printing device 200 may prevent the opening of manifold latch 205 in particular positions The controller 209 may align the carriage 201 in the capped position in a number of circumstances. For instance, the controller 209 may align the carriage 201 in the capped position in response to a determination that the manifold latch 205 is in a closed position (as illustrated in FIG. 2), and a determination that a pen body in the integrated printhead 203 does not have an error. Put another way, if the manifold latch 205 is closed, and the integrated printhead 203 has good health, then the controller 209 may align the carriage 201 in a position such that a user may not access the integrated printhead 203.

As such, the controller 209 may determine a level of health of the integrated printhead 203. Therefore, in response to a determination of the level of health of the integrated printhead 203, the controller 209 may move the position of the carriage 201 based on both the manifold latch 205 position and the level of health of the integrated printhead 203, as described further in relation to FIG. 3.

Figure 3:
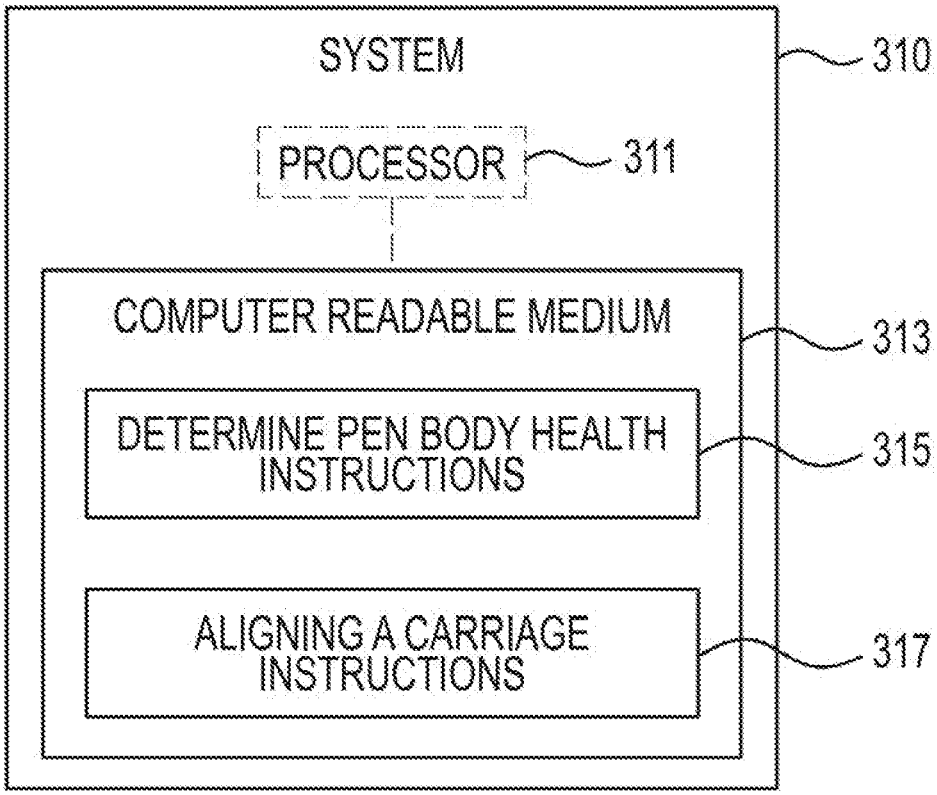
FIG. 3 is a block diagram of an example system for aligning a carriage within a printing device, according to the present disclosure.

FIG. 3 is a block diagram of an example system 310 for aligning a carriage within a printing device, according to the present disclosure. System 310 may be the same as or different than, the printing device 100 illustrated in FIG. 1 and the printing device 200 illustrated in FIG. 2. System 310 may include at least one computing device that is capable of communicating with at least one remote system. In the example of FIG. 3, system 310 includes a processor 311 and a computer-readable medium 313. Although the following descriptions refer to a single processor and a single computer-readable medium, the descriptions may also apply to a system with multiple processors and computer-readable mediums. In such examples, the instructions may be distributed (e.g., stored) across multiple computer-readable mediums and the instructions may be distributed (e.g., executed by) across multiple processors.

Processor 311 may be one or more central processing units (CPUs), microprocessors, and/or other hardware devices suitable for retrieval and execution of instructions stored in computer-readable medium 313. In the particular example shown in FIG. 3, processor 311 may receive, determine, and send instructions 315, and 317 for aligning a carriage within a printing device. As an alternative or in addition to retrieving and executing instructions, processor 311 may include one or more electronic circuits comprising a number of electronic components for performing the functionality of one or more of the instructions in computer-readable medium 313. With respect to the executable instruction representations (e.g., boxes) described and shown herein, it should be understood that part or all of the executable instructions and/or electronic circuits included within one box may, in alternate embodiments, be included in a different box shown in the figures or in a different box not shown.

Computer-readable medium 313 may be any electronic, magnetic, optical, or other physical storage device that stores executable instructions. Thus, computer-readable medium 313 may be, for example, Random Access Memory (RAM), an Electrically-Erasable Programmable Read-Only Memory (EEPROM), a storage drive, an optical disc, and the like. Computer-readable medium 313 may be disposed within system 310, as shown in FIG. 3. In this situation, the executable instructions may be "installed" on the system 310. Additionally and/or alternatively, computer-readable medium 313 may be a portable, external or remote storage medium, for example, that allows system 310 to download the instructions from the portable/external/remote storage medium. In this situation, the executable instructions may be part of an "installation package". As described herein, computer-readable medium 313 may be encoded with executable instructions for aligning a carriage within a printing device.

Referring to FIG. 3, determine pen body health instructions 315, when executed by a processor (e.g., 311), may cause system 310 to determine a level of health of a pen body in an integrated printhead, as described in relation to FIG. 1 and FIG. 2. That is, the system 310 may determine whether an integrated printhead (such as integrated printhead 103 illustrated in FIG. 1) has reported an error or not. As such, the determine pen body health instructions 315 may include instructions to read pen data relating to a historical functioning of the pen body, and determine the level of health of the pen body based on the read pen data. That is, the determine pen body health instructions 315 may include instructions to read the pen data, and determine if the pen body has failed during a particular period of time, if the pen body is missing altogether, and/or if a threshold number of nozzles on the integrated printhead are malfunctioning. If any of these circumstances are reported, an error is identified in the pen data. Conversely, if none of these circumstances are reported, no error is identified in the pen data and an image quality check may be performed. As such, the determine pen body health instructions 315 may include instructions to initiate an image quality check, in response to a determination that no error was reported in pen data relating to the historical functioning of the pen body. As used herein, an image quality check refers to a process by which a pen health page is printed by the printing device, the printed pen health page is scanned, and an image quality check is performed on the scanned pen health page. During the printing of the pen health page, a plurality of color blocks may be printed from the pen. Once the printed pen health page is scanned by the printing device, each of the plurality of color blocks may be analyzed for color content. If any of the plurality of color blocks include less than a threshold level of color (such as 50%), as defined by a manufacturer of the printing device, the image quality check may be reported as "failed". Conversely, if all of the plurality of color blocks include more than the threshold level of color, the image quality check may be reported as "passed", and the pen body may be determined to be in "good" health, or to be without error.

Although examples herein describe an image quality check process being performed following a determination that the pen body does not have an error, examples are not so limited. In some instances, the image quality check process may be skipped altogether, and the pen body health may be based solely on the read pen data.

The determine pen body health instructions 315 may include instructions to determine that the pen body has an error (e.g., is in poor health), in response to a determination that the pen body has failed within a specified period of time, the pen body is missing, and/or a threshold number of nozzles on the pen body are damaged. Conversely, the determine pen body health instructions 315 may include instruction to determine that the pen body has an acceptable level of health (e.g., does not have an error), in response to a determination that no error was in the read pen data relating to historical functioning of the pen body, and a determination that a printed pen health page passed an image quality check, as described herein.

Align the carriage instructions 317, when executed by a processor (e.g., 311), may cause system 310 to align a carriage including the integrated printhead in a particular position within a printing device based on the determined level of health of the pen body. For example, as discussed in relation to FIGS. 1 and 2, the carriage may be aligned in either a capped or a pen present position based at least in part on the level of health of the pen body.

Figure 4:
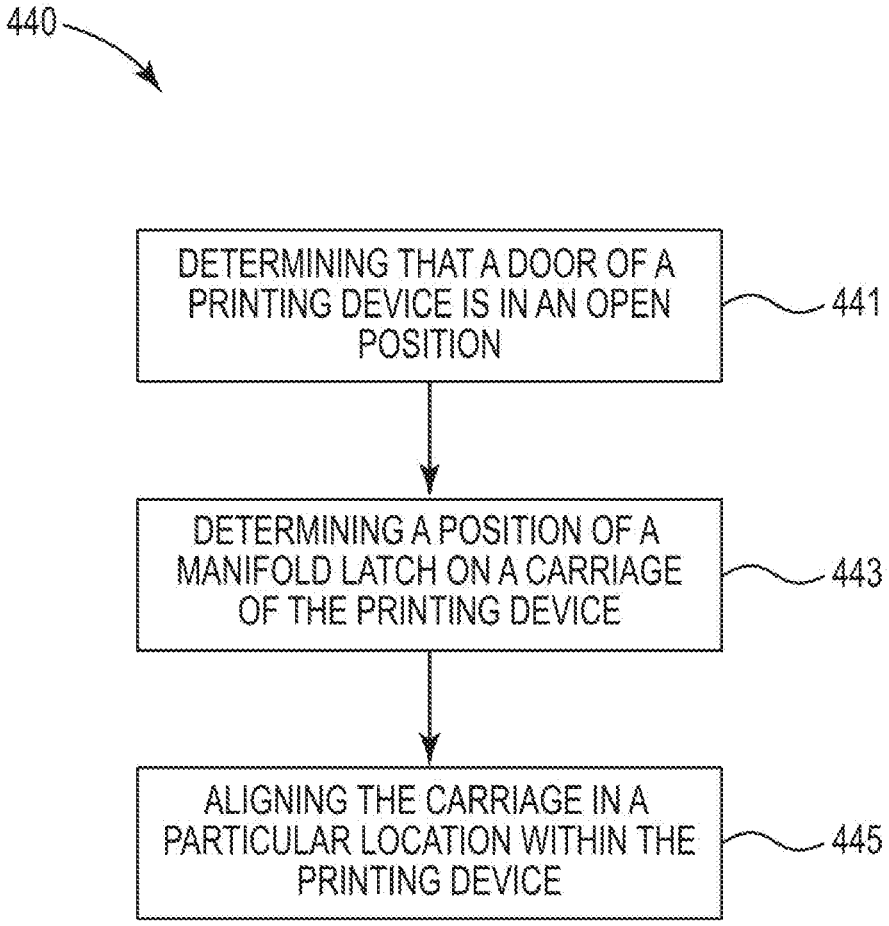
FIG. 4 illustrates an example method for aligning a carriage within a printing device, according to the present disclosure.

FIG. 4 illustrates an example method 440 for aligning a carriage within a printing device, according to the present disclosure. At 441, the method 440 may include determining that a door of a printing device is in an open position. In some instances, a user may open a door of the printing device in order to access the carriage (e.g., carriage 101 illustrated in FIG. 1), and/or to inspect internal components of the printing device. FIGS. 1 and 2 illustrate the printing device with an opened door. If the pen body on the integrated printhead in the printer is in good health, it may be beneficial to prevent a user from accessing the integrated printhead, and therefore maintaining the carriage containing the integrated printhead in a capped position, as described herein.

As such, at 443, the method 440 may include determining a position of a manifold latch on a carriage of the printing device in response to the determination that the door is open. That is, the method 440 may include determining if the manifold latch is in an open position, as illustrated in FIG. 1, or a closed position, as illustrated in FIG. 2.

At 445, the method 440 may include aligning the carriage in a particular location within the printing device based on the determined manifold latch position. Referring to FIG. 2, the method 440 may include moving the carriage 201 along the bar 206 into a position such that the manifold latch 205 may not be opened.

Furthermore, as described herein, the method 440 may include determining a level of health of an integrated printhead inserted in the carriage. As such, the method 440 may include aligning the carriage to the particular location based on the determined manifold latch position and the level of health of the integrated printhead. Put another way, if the manifold latch is opened, the carriage may be moved to pen present position. If the manifold latch is closed, the carriage may be moved to pen present position only if a pen body in the integrated printhead is in poor health. Conversely, if the manifold latch is closed, the carriage may be maintained in, or moved to, the capped position if the pen body or pen bodies in the integrated printhead or integrated printheads are in good health. Again, as described herein, the pen body may be in poor health if an error is reported in the pen data and/or if an image quality check is failed. The pen body may be in good health if no error is reported in the pen data and/or if the image quality check is passed. As such, aligning the position of the carriage 445 may include aligning the carriage in a pen present position, in response to a determination that the manifold latch is in a closed position, and a determination that a component of the integrated printhead has an error. However, aligning the position of the carriage 445 may also include aligning the carriage in a capped position in response to a determination that the manifold latch is in a closed position, and a determination that a component of the integrated printhead does not have an error.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, "a number of" an element and/or feature can refer to one or more of such elements and/or features.

The invention claimed is:

1. A printing device, comprising:

a carriage to hold an integrated printhead in the printing device;

a manifold latch to connect the integrated printhead and an ink tank connector in a locked position; and a controller to:

align the carriage within the printing device, based on a level of health of the integrated printhead and a latching position of the manifold latch.

2. The printing device of claim 1, including the controller to:

determine if the manifold latch is in an opened or closed position.

3. The printing device of claim 1, including the controller to align the carriage in a pen present position, in response to a determination that the manifold latch is in an open position.

4. The printing device of claim 1, including the controller to align the carriage in a pen present position, in response to a determination that:

the manifold latch is in a closed position; and a pen body in the integrated printhead has an error.

5. The printing device of claim 1, including the controller to align the carriage in a capped position, in response to a determination that:

the manifold latch is in a closed position; and a pen body in the integrated printhead does not have an error.

6. The printing device of claim 1, further including the controller to:

determine a level of health of the integrated printhead; and move a position of the carriage based on the manifold latch position and the level of health of the integrated printhead.

7. A non-transitory computer readable medium containing instructions executable by a processor to:

determine a level of health of a pen body in an integrated printhead; and align a carriage, that includes the integrated printhead and a manifold latch, in a particular position within a printing device based on the determined level of health of the pen body and a latching position of the manifold latch.

8. The medium of claim 7, wherein the instructions to determine the level of health of the pen body include instructions to:

read pen data relating to a historical functioning of the pen body; and determine the level of health of the pen body based on the read pen data.

9. The medium of claim 7, wherein the instructions to determine the level of health of the pen body include instructions to:

initiate an image quality check, in response to a determination that no error was reported in pen data relating to a historical functioning of the pen body.

10. The medium of claim 7, wherein the instructions to determine the level of health of the pen body include instructions to:

determine that the pen body has an error, in response to a determination that:

the pen body has failed within a specified period of time;

the pen body is missing; or a threshold number of nozzles on the pen body are damaged.

11. The medium of claim 7, wherein the instructions to determine the level of health of the pen body include instructions to:

determine that the pen body has an acceptable level of health, in response to:

a determination that no error is in read pen data relating to historical functioning of the pen body; and a determination that a printed pen health page passed an image quality check.

12. A method comprising:

determining that a door of a printing device is in an open position;

determining a position of a manifold latch on a carriage of the printing device in response to the determination that the door is open; and aligning the carriage in a particular location within the printing device based on the determined manifold latch position.

13. The method of claim 12, further comprising:

determining a level of health of an integrated printhead inserted in the carriage;

wherein aligning the carriage in a particular location includes moving the carriage to the particular location based on the determined manifold latch position and the level of health of the integrated printhead.

14. The method of claim 12, wherein aligning the position of the carriage includes:

aligning the carriage in a pen present position in response to:

determining that the manifold latch is in a closed position; and determining that a component of the integrated printhead has an error.

15. The method of claim 12, wherein maintaining the position of the carriage includes:

maintaining the carriage in a capped position in response to:

determining that the manifold latch is in a closed position; and determining that a component of the integrated printhead does not have an error.

* * * * *